US005320278A

United States Patent [19]

Kolarik et al.

[11] Patent Number: 5,320,278

[45] Date of Patent: Jun. 14, 1994

[54] HIGH PRESSURE FUEL INJECTOR WITH FUEL DRAINAGE VALVE

[75] Inventors: Oldrich S. Kolarik, Summerville; Tibor J. Villanyi, Hanaham, both of S.C.

[73] Assignee: Cummins Engine Company, Inc., Columbus, Ind.

[21] Appl. No.: 96,935

[22] Filed: Jul. 26, 1993

[51] Int. Cl.[5] ..... F02M 55/00

[52] U.S. Cl. ..... 239/90; 239/95; 123/446

[58] Field of Search ..... 239/88-92, 239/95, 96; 123/446, 500-502

[56] References Cited

U.S. PATENT DOCUMENTS 4,463,901 8/1984 Perr et al. ..... 239/95

4,699,320 10/1987 Sisson et al. ..... 239/95

*Primary Examiner*—Karen B. Merritt

*Attorney, Agent, or Firm*—Sixbey, Friedman, Leedom & Ferguson

[57] ABSTRACT

An improved high pressure fuel injector for internal combustion engines in which problems of hysteresis delays and fuel leakage at the commencement of the metering process can be avoided without affecting the ability to precisely control the fuel supply pressure by the provision of a way for the metering and injection plunger to be acted upon only by the pressure of the incoming fuel supply. An improved metering and injection plunger spring arrangement provides a valving of the drain path that prevents leakage through drain passages and/or about the metering and injection plunger during the fuel metering and injection phases. Also, a double check valve arrangement is incorporated into the plunger seat disc to minimize the possibility of backflow leakage of fuel during injection of the fuel from the metering and injection chamber.

20 Claims, 5 Drawing Sheets

HIGH PRESSURE FUEL INJECTOR WITH FUEL DRAINAGE VALVE

BACKGROUND OF THE INVENTION

1. Field of the Invention

The present invention is related to the field of high pressure fuel injectors for internal combustion engines of the closed nozzle type having a metering and injection plunger assembly that is mounted for reciprocal movement within a variable volume metering and injection chamber that is formed in the body of the fuel injector. More specifically, the invention relates to such fuel injectors, particularly unit fuel injectors, where the metering and injection plunger assembly has a return spring against the force of which the metering and injection plunger is raised by the supply of fuel being metered into the metering and injection chamber.

2. Description of Related Art

Fuel injectors of the initially mentioned type are known. One example of such a fuel injector is shown in U.S. Pat. No. 4,463,901 (which is owned by the assignee of this application), and FIG. 1 of this application represents another example of this type of fuel injector that is produced by the assignee of this application. While each of these closed nozzle fuel injections systems represented state-of-the-art systems at the time at which it was developed, the increasing demands for higher fuel economy and further decreases in emissions have placed addition demands for improvements in such fuel supply systems for internal combustion engines. These demands have led to fuel injectors being required to meet stricter performance characteristics, especially for more precise fuel metering.

However, fuel injectors of the above-mentioned type have a return spring which presses down on the metering and injection plunger, collapsing the metering and injection chamber and forcing the metering and injection plunger into engagement with a plunger seat after injecting of fuel into the engine has been completed. The return spring also has the effect of establishing a preload force which must be overcome before fuel can flow into the metering and injection chamber at the start of the next injection cycle. Additionally, in the collapsed condition of the metering and injection chamber, with the metering and injection plunger in engagement with the top surface of the plunger seat, the pressure of the fuel being supplied is only able to work on a limited area of the bottom face of the metering and injection plunger, i.e., an area equal to the total cross-sectional area of the fuel feed passage(s) by which fuel is able to flow into the metering and injection chamber when the plunger is in engagement with the plunger seat. Also, the fuel being supplied is unable to act at or near the center of the plunger bottom face because a T-shaped drain passage is formed in the metering and injection plunger at its center, the inlet end of this passage being blocked by the plunger seat when the metering and injection chamber has been fully collapsed.

In the FIG. 1 injector, the T-shaped passage 1 is provided in the plunger P to form a path of communication between the metering and injection chamber and a fuel drain passage 3 in the injector body for quickly reducing the pressure within the metering and injection chamber so as to produce a positive and predictable end to the injection event. However, this arrangement leads to the need to precisely control the size of the orifice at the inlet end of fuel drain passage 3 since the orifice sizing is the only means of flow regulation for drain passage 3. Furthermore, this construction creates the situation where, at the time that the fuel supply is commenced, the metering and injection plunger P is exposed to two very different pressures, i.e., the high pressure of the fuel supply, which is delivered via a supply passage 5 formed in a fuel distributing plunger seat 6, and the low pressure of the engine drain flowpath which is in communication with the T-shaped passage 1. This pressure differential causes a bleeding of pressure from the supplied fuel, as well as a tendency for the fuel to find a leakage path to the drain passage 3 via the T-shaped passage 1 or about the plunger P. More specifically, the fuel supply pressure must be high enough to produce initial lifting off of the metering and injection plunger P despite the limited exposure of the fuel to the plunger at peripheral areas thereof and without causing the fuel supply to find a leakage path to the drain passage or about the plunger to the top side thereof (which is also at the low pressure of the engine drain flowpath). As a result, these factors combine to produce a hysteresis effect which affects the ability of the injector to rapidly and precisely meter fuel into the fuel metering and injection chamber. In either case, the occurrence of an initial delay in raising of the plunger or the leaking of supplied fuel to a drain has the effect of detracting from the precise control of the fuel metering and injection process that is important to achievement of high fuel economy and low emissions.

In the case of the noted U.S. Pat. No. 4,463,901, a similar T-shaped drain passage is provided in the metering and injection plunger; however, instead of communicating with a drain passage at the end of the injection stroke to quickly reduce the pressure, the metering and injection chamber is brought into communication with a discharge path that leads the remaining fuel back to the fuel supply passage. While this approach avoids the above-noted hysteresis delay problem during commencement of the fuel supply phase (a problem which would exist in this injector, as well, if its discharge passages led to the engine drain flowpath, as is indicated in the patent to be a less desirable, but possible, alternative), it introduces another problem. That is, in unit fuel injectors of the type in question, the quantity of fuel metered is controlled by the pressure of the fuel supplied as well as the time during which it is supplied (called PT metering), and a common fuel supply rail delivers fuel to a plurality of injectors in a timed sequence. Typically, the pressure of the fuel supplied to the injectors is about, e.g., 10 psi to 100 psi; on the other hand, the pressure of the fuel in the metering and injection chamber, when it is discharged at the end of the injection event, is more than an order of magnitude greater, e.g., 20,000 psi. Thus, by discharging the fuel from the metering and injection chamber back into the fuel supply path, a pressure spike is induced into the pressure-controlled fuel supply, and this pressure spike reduces the preciseness with which the fuel supply quantity can be controlled.

SUMMARY OF THE INVENTION

In view of the foregoing, it is an object of the present invention is to provide an improved high pressure fuel injector for internal combustion engines in which the problems of hysteresis delays and fuel leakage at the commencement of the metering process can be avoided without affecting the ability to precisely control the fuel supply pressure.

A second objective of the present invention is to provide an improved high pressure fuel injector for internal combustion engines which can achieve the preceding object by providing a way for the metering and injection plunger to be acted upon only by the pressure of the incoming fuel supply.

Yet another object of the present invention is to provide a high pressure fuel injector for internal combustion engines that uses an improved metering and injection plunger spring arrangement which provides a valving of the drain path that prevents leakage through drain passages and/or about the metering and injection plunger during the fuel metering and injection phases.

In accordance with a preferred embodiment of the invention, the above and other objects are achieved in a fuel injector having a fuel supply path via a plunger seat disc that forms the bottom of the metering and injection chamber and which communicates the plunger drain passage with the incoming fuel supply. Furthermore, either the return spring arrangement is constructed so that it can serve a valving function in addition to its usual plunger returning function or a separate spring and spring keeper arrangement can provide this valving function.

Additionally, a double check valve arrangement is incorporated into the plunger seat disc to minimize the possibility of back-flow leakage of fuel during injection of the fuel from the metering and injection chamber.

These and other objects features and advantages of the present invention will become more apparent from the following detailed description of the preferred embodiments of the invention when viewed in conjunction with the accompanying drawings.

DETAILED DESCRIPTION OF THE PREFERRED EMBODIMENTS

Figure 1:
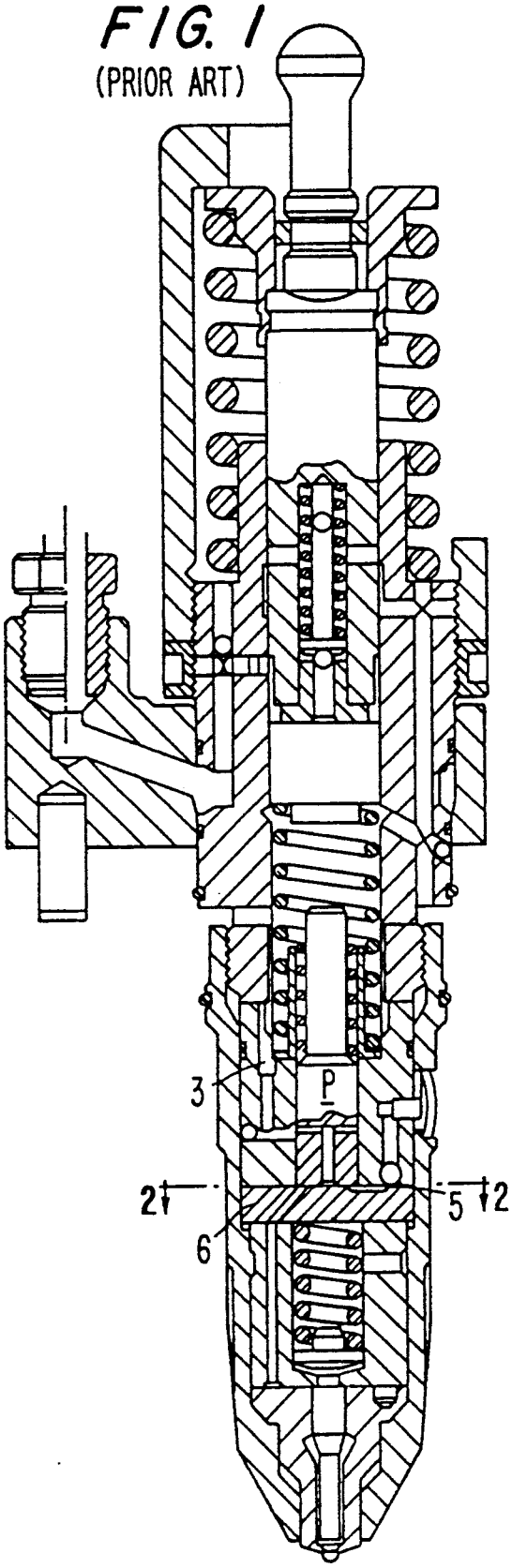
FIG. 1 (PRIOR ART)
FIG. 1 is a partial cross sectional view of a closed nozzle fuel injector with a conventional metering and injection plunger assembly.
Figure 3:
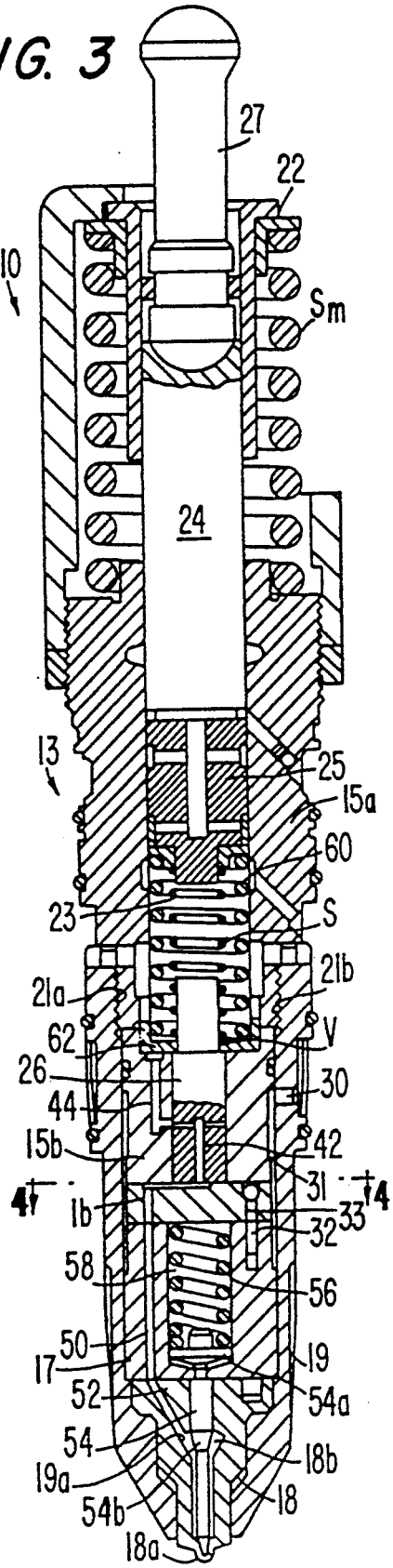
FIG. 3 is a view corresponding to that of FIG. 1 but of an injector having an improved the metering and injection plunger assembly in accordance with the present invention.
Figure 2:
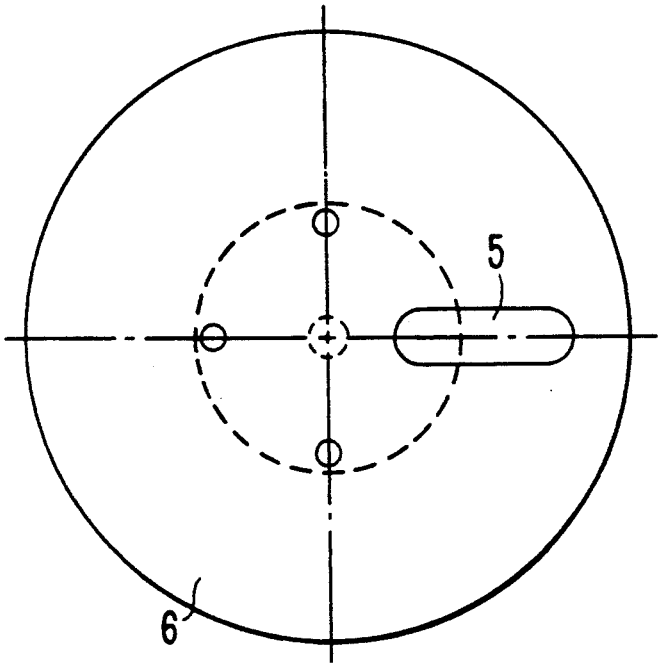
FIG. 2 PRIOR ART
FIG. 2 is an enlarged view taken along line 2—2 in FIG. 1, and in which the projected circumference of the lower end face of the injection and metering plunger and of the inlet of its drain passage are represented in dashed lines.

FIG. 3 illustrates a closed nozzle unit fuel injector in accordance with the present invention, which is designated generally by reference numeral 10. The fuel injector 10 is intended to be received within a recess in the head of an internal combustion engine (not shown) in a conventional manner. The injector 10 is formed of an injector body 13, that has an upper injector barrel part **15*a*, a lower injector barrel part 15*b*, a fuel distributing plunger seat disc 16, a spring housing block 17, an injector cup 18 having an injection nozzle 18*a* with spray orifices for spraying fuel into the combustion chamber (not shown) of an internal combustion engine, and a retainer 19 having a shoulder 19*a* for capturing the injector cup 18. The retainer 19 receives the injector cup 18, supported on shoulder 19*a* with spray nozzle 18*a* projecting from the bottom end thereof. The lower barrel part 15*b* is received in the retainer 19 supported on the plunger seat disc 16 which is stacked on the spring housing block 17 and injector cup 18. Furthermore, retainer 19 secures the received parts together in end-to-end fashion with the upper barrel part 15*a*. For this purpose, the top end of the retainer 19 has internal threads 21*a* by which it is connected to external threads 21*b* on the bottom end of upper injector body part 15*a*, as shown. A central bore extends through the barrel parts 15*a*–15*b* of the injector body 13 of the fuel injector 1, and a reciprocating plunger assembly 23** is disposed in this central bore.

Figure 6:
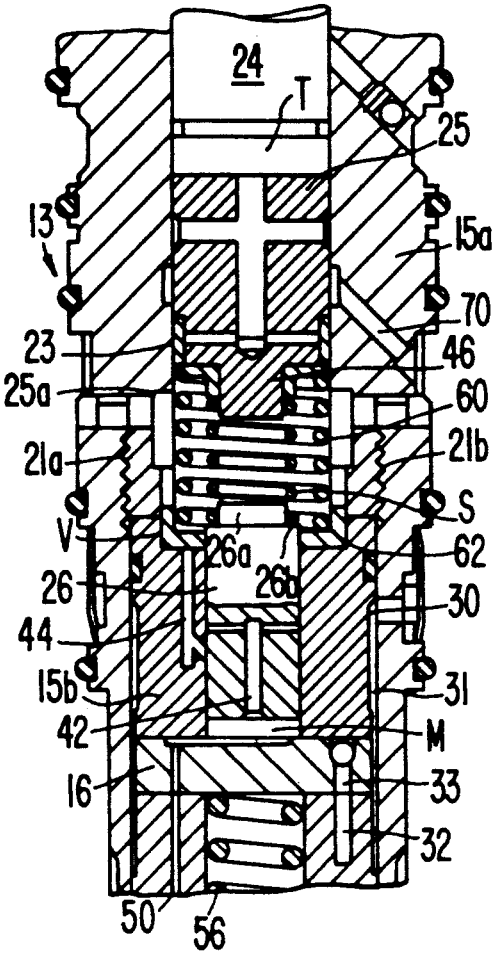
FIG. 6 is an enlarged view of a central portion of the injector shown in FIG. 3 during an injection stroke.

The plunger assembly 23 includes three plungers. An upper plunger 24, a timing plunger 25, and an injection and metering plunger 26. The fuel injector 10 is part of a fuel injection system having a plurality of such injectors, each of which is driven by a rotating camshaft (not shown) via a conventional drive train assembly which includes a link 27 that causes the plunger assembly 23 to reciprocate in synchronism therewith. The injection system also includes a fuel pump which supplies all of the fuel injectors by a common rail system (not shown) which requires three common fluid rails within the cylinder head, one for supplying fuel into the injection chamber, one for draining away fuel that is not injected and the third which supplies timing fluid (which may also be fuel) to vary the timing of the injection event by varying the quantity of timing fluid supplied to a variable volume timing chamber T (FIG. 6) defined between the bottom of the upper plunger 24 and the top of the timing plunger 25. These aspects are not novel to the present invention and are described in greater detail in the above-noted U.S. Pat. No. 4,463,901.

The '901 patent also describes the need to drain fuel from the metering and injection chamber M via a T-shaped drain passage in the injection and metering plunger 25, at the end of each injection stroke for quickly reducing the pressure within the metering and injection chamber M so as to produce a positive and predictable end to the injection event as well as to reduce the requirement for a large "hold down" force to be created by the fluid in the timing chamber, thus reducing camshaft loading. The manner in which the timing fluid is supplied and discharged is described in commonly assigned, co-pending U.S. patent application Ser. No. 07/898,818, filed Jun. 15, 1992, which shares a common inventor with this application. As a result, these aspects need not be described in greater detail and the following description will focus on the novel aspects of this invention. However, to the extent that a further description of these features should be necessary to a full understanding of this invention, reference can be made to said patent and application which are hereby incorporated by reference for this purpose.

Figure 4:
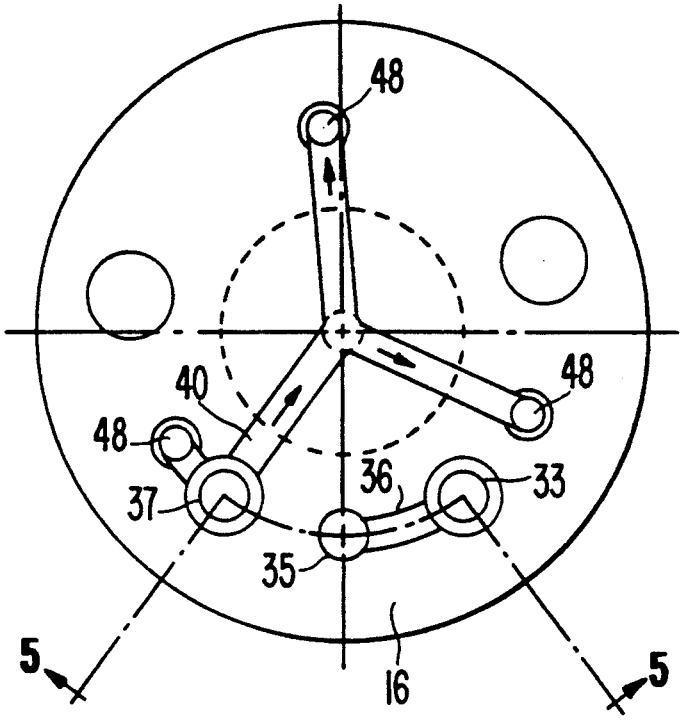
FIG. 4 is an enlarged view taken along line 4—4 in FIG. 3, in which the projected circumference of the lower end face of the injection and metering plunger and of the inlet of its drain passage are represented in dashed lines.
Figure 5:
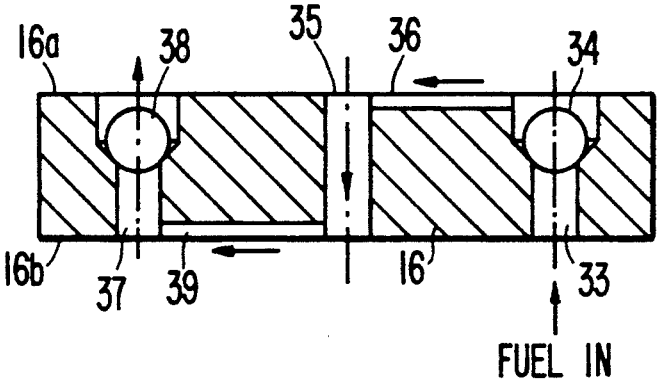
FIG. 5 is a view taken along line 5—5 in FIG. 4, in which the projected area of the circumference of the lower end face of the injection and metering plunger and of the inlet of its drain passage are represented in dashed lines.

A first significant development in accordance with the present invention relates to the manner in which fuel is supplied to the metering and injection chamber M. In FIG. 3, the injector 10 is shown at the beginning of an injection cycle with the plunger assembly 23 fully expanded (upper plunger 24 being raised, and the injection and metering plunger 26 being engaged on plunger seat disc 16). Timing fluid and fuel to be injected into the engine are then pumped into the injector. The fuel enters the injector 10 through a port 30 in the retainer 19 and travels through a flow path 31 between the inside of retainer 19 and the periphery of lower barrel **13*b*, plunger seat disc 16 and spring housing block 17 to a passage 32 in the spring housing block 17. From passage 32, the fuel flows to a first passage 33 in the flow distributing plunger seat disc 16 which contains a ball-type check valve 34. The pressure of the fuel is sufficient to open the check valve 34 and it is able to flow to a second passage 35 via a channel 36 formed in the top face 16*a* of the plunger seat disc 16 (FIGS. 4 and 5). Similarly, a third passage 37 has a check valve 38 and is connected to the second passage 35 via a channel 39 formed in the underside 16*b* of the plunger seat disc 16**.

As indicated by the dashed-line projection of the metering and injection plunger 26 onto the plunger seat disc 16 shown in FIG. 4, the passages 33, 35, and 37 as well as the channels 36 and 39 lie radially outwardly of the plunger 26, and thus, lie in an area in which the lower barrel part **13*b* engages on the plunger seat disc 16 and the plunger seat disc 16 engages on the spring housing block 17. As a result, the lower barrel part 13*b* serves to cover and close the passages 33, 35, and 37 and channel 36 from above, and a similar function is served by the spring housing block relative to channel 39**.

After passing through the second check valve 38, the fuel being metered into the injector 1 flows radially inwardly along a channel 40 that is formed in the top face **16*a* of the plunger seat disc 16 to the center of the bottom end face of plunger 26, despite the fact that it is seated on disc 16. When the fuel reaches the center of the plunger bottom end face, it is able to enter into the T-shaped drain passage 42. While the use of a sufficiently small orifice between the outlet end of the drain passage 42 and a drain passage 44 in the lower barrel 13*b* can serve to prevent the fuel from then flowing out via the drain passage 44, preferably, the outlet of the drain passage 44 is blocked by a pressure responsive valve V described in greater detail below. At the same time, the fuel in channel 40 is also able to flow to the passages 48 in disc 16 and 50 in spring housing block 17 (only one of which is shown), and then into the passages 52 of the injector cup 18 (only one of which is shown) which lead to the nozzle chamber 18*b***.

Because the lower end of the metering and injection plunger is only experiencing the pressure of the incoming fuel, it is able to quickly respond to the pressure of the incoming fuel and rises against the force of its return spring s without any hysteresis delay and without any leakage of the fuel from the metering and injection chamber M. Since the quantity of fuel metered into the chamber M is a function of the fuel pressure and metering time, the fuel dosage to be injected can be precisely controlled, as a result. The return spring s has a lower end that is mounted about a reduced-diameter upper end portion **26*a* of the metering and injection plunger 26 in engagement with a shoulder 26*b*, and an upper end which is mounted about a reduced-diameter lower end portion 25*a* of the timing plunger 25 in engagement with an upper spring keeper 46** disposed on shoulder thereof.

After the required quantity of fuel has been metered into chamber M, the downwardly moving, hydraulically linked upper and timing plungers 24 and 25 will engage will engage on injection and metering plunger 26 and drive it downwardly. This application of pressure to plunger 26 pressurizes the fuel in injection and metering chamber M as well as in the flow path leading to orifices **18*a*, which is comprised of passages 48 in plunger seat disc 16, passages 50 in spring housing block 17, passages 52 in the injector cup 18 and the nozzle chamber 18*b* that is formed around the lower portion of a nozzle tip valve 54**.

Nozzle tip valve 54 is held in position closing the orifices **18*a* by a spring 56 that is located in spring chamber 58 of spring housing 17 and which acts on a hold-down portion 54*a* of tip valve 54. When the pressure of the fuel acting on conic portion 54*b* of tip valve 54 exceeds that imposed by spring 56, the tip valve 54 unblocks nozzle orifices 18*a* and fuel is injected into the combustion chamber of the engine in a conventional manner. The presence of two check valves 34, 38, decreases the possibility of the injector being rendered nonfunctional due to a leaking valve; although, it would be possible to eliminate check valve 34. Conveniently, the ball-type check valves 34, 38 are by formed by enlarging the upper ends of passages 33 and 37 to form the seat for the ball member of the respective ball-type check valve, which can simply be dropped in place and prevented from coming by the bottom surface of the lower injector barrel part 15*b*** which is held in place thereover.

Figure 7:
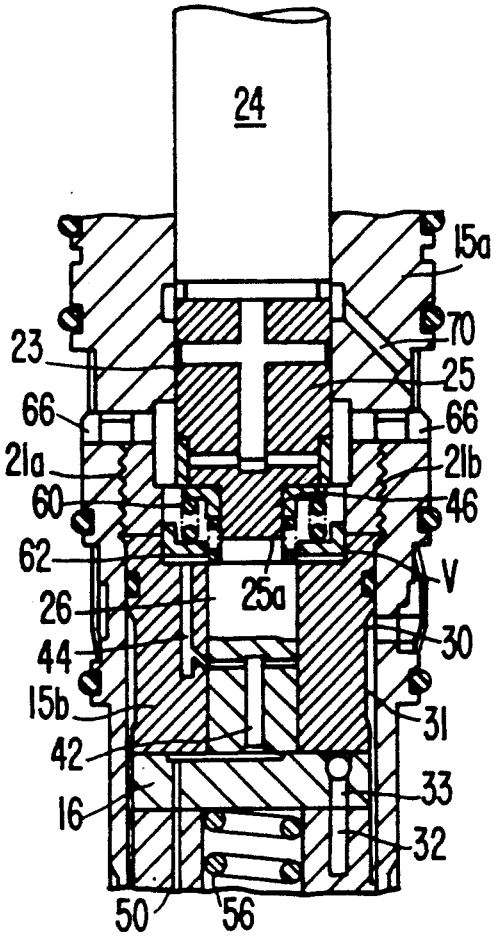
FIG. 7 is view similar to that of FIG. 6 but at the end of an injection event.

In order to produce a positive and predictable end to the injection event, the pressure within injection and metering chamber M is quickly reduced when the injection and metering plunger 26 nears its lowermost position. This is achieved via valve V. Valve V is formed by return spring 60 and its lower spring keeper 62. Spring keeper 62 is designed to seat on an upper end surface of lower injector barrel part **15*b* over the area in which the drain passage 44 opens. Thus, the force of return spring 60 will act to hold the spring keeper 62 in its position closing drain passage 44 closed until the pressure of the fuel in injection and metering chamber M exceeds a predetermined level, at which time the force of return spring 60 will be overcome by the fuel pressure and the spring keeper will be lifted (as shown in FIG. 7) allowing fuel to drain from the chamber M, through drain passage 44, into the low pressure space surrounding spring 60 and out of the injector into the engine drain flowpath via ports 66. This also reduces the requirement for a large "hold-down" force to be produced by the fluid in the timing chamber and thus, reducing camshaft loading. In this regard, it is noted that a timing fluid discharge passage 70 is located to communicate with the timing chamber T just before the metering and injection plunger 26 reaches its lowermost position, so that timing fluid can be discharged in a pressure regulated manner (described in the above-noted co-pending application) which produces a substantial hold-down pressure throughout the remainder of the downward movement of the upper plunger 24**.

When the upper plunger begins to retract, the timing plunger return spring 60 will lift the timing plunger, and at the same time, will insure that the valve V recloses, if it has not already done so due to a drop in pressure within drain passage 44 and chamber M. The plunger assembly, then returns to the FIG. 3 expanded condition and another injection cycle, as described, commenced.

Figure 8:
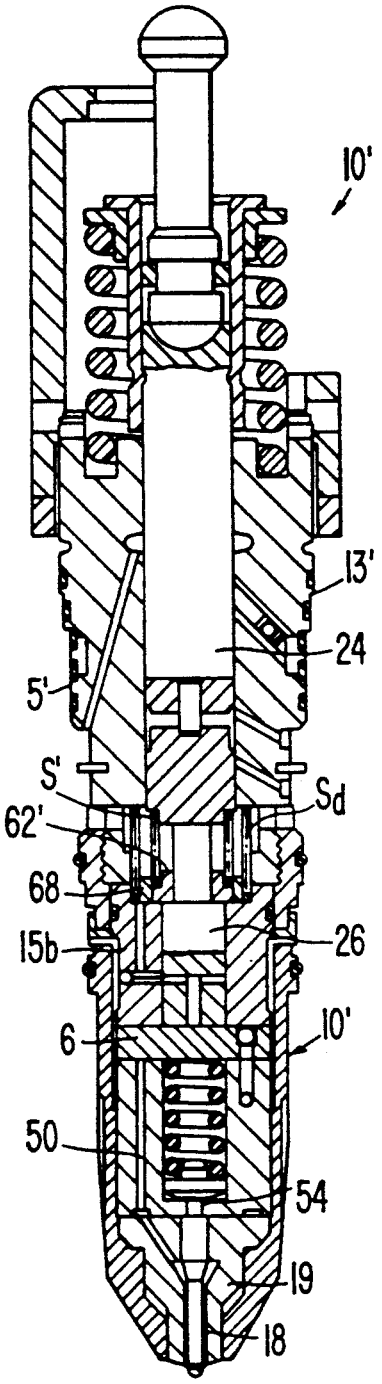
FIG. 8 is a cross-sectional view similar to that of FIG. 3 but of an injector having a most preferred form of the drain passage valving arrangement of the present invention.
Figure 9:
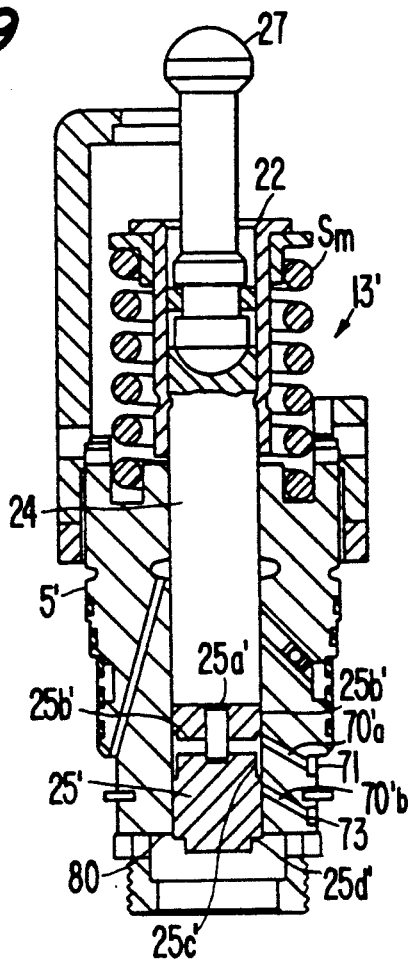
FIG. 9 is a cross-sectional view of the top half of the FIG. 8 injector.
Figure 10:
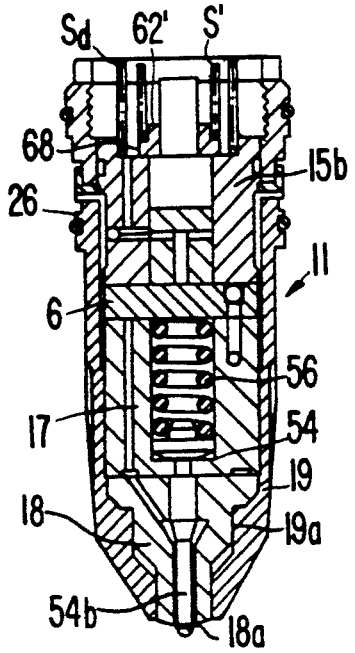
FIG. 10 is a cross-sectional view of the bottom half of the FIG. 8.

FIGS. 8–10 show a further, most preferred form of the present invention which, for the most part, conforms with that of FIGS. 3–7. While minor differences exist in the timing control piston 25' and the manner in which timing fluid is discharged therefrom, the primary difference lies in the use of a separate drain valve 68 and drain spring $S_d$ to control drainage of fuel from the metering and injection chamber M. Thus, to facilitate comparision, like reference numerals are used for like parts of these two embodiments and and prime (') designations are used to identify a corresponding part that has been modified in the embodiment of FIGS. 8–10 relative to that of FIGS. 3–7.

Firstly, as with the embodiment of FIGS. 3–7, the top half of the injector 10' is comprised of a main return spring housing or top stop 22 which is mounted on an upper barrel part 5', a main return spring $S_m$ that is held between barrel 5' and an injector coupling, which is carried by an upper plunger 24 and has an injector link 27 (which forms part of an unillustrated, conventional cam-driven injector drive train) loosely secured therein, as well as an intermediate, timing plunger 25' that is located below the upper plunger 24 and which defines a variable volume timing chamber between its upper surface and the bottom face of the upper plunger 24. The top half of injector 10' also includes a timing chamber relief valve assembly which comprises a plunger drain path, formed in the timing plunger 25' by an axial passage 25'a which communicates with a plurality of radial bores 25'b which open into annular groove 25c, and in the upper barrel part 5', by at least one valved passage 70'a or at least one valve passage 70'b (depending on the location of the timing plunger) which connect this groove 25c, in turn, with the drain rail of the the engine head (not shown) via respective band-like high pressure limiting valves 71 and 73 that are mounted on the outside of injector upper barrel part 5'. The relief valve assembly constitutes a pressure actuated valve means for commencing and blocking a flow of timing fluid through the plunger drain path and the at least one passage 70'a, or 70'b in dependence upon whether the pressure of the timing fluid exceeds or is below a predetermined value set by the band-like valve spring. In the illustrated embodiment, the upper barrel part 5' serves as a valve body having a circumferential wall with at least one surface area in which the outlet port of the at least one passage 70'a or 70'b is formed, and over which the band-like resilient valve spring member is mounted so as to seal the at least one port in a closed condition thereof and so as to resiliently move into a second, open condition, in which said band-like spring member is displaced from said circumferential wall for permitting discharge of timing fluid from the at least one port, under pressure exerted by the timing fluid in the at least one port.

Since the further details of the nature and operation of the timing chamber relief valve assembly are identical to that disclosed in commonly owned, co-pending U.S. patent application Ser. No. 07/898,818, reference can be made to that patent application for such details, it being hereby incorporated by reference for that purpose.

However, it is noted that the limiting valves 71, 73, comprise a continuous or split valve spring member mounted over the outside of injector upper barrel part 5' in a way that permits the preloading of the spring member to be concentrated in the area of one or more outlet ports to be closed thereby, such that high pressures can be regulated with precision. Also, while the spring member is shown mounted on an outer surface of an injector upper barrel part 5', mounting of the valve spring member on the timing plunger, as described in the reference Ser. No. 07/898,818, is also possible. Furthermore, the limiting valves 71, 73 may take the form of any of the various valve embodiments of that application as well.

FIG. 10 illustrates the lower half of the closed nozzle type injector shown in FIG. 8, which comprises a lower injector barrel part 15b, a fuel distributing plunger seat disc 6, a spring housing block 17, an injector cup 18 having an injection nozzle 18a with spray orifices for spraying fuel into the combustion chamber (not shown) of an internal combustion engine, and a retainer 19 having a shoulder 19a for capturing the injector cup 18. The retainer 19 receives the injector cup 18, supported on shoulder 19a with spray nozzle 18a projecting from the bottom end thereof. The lower barrel part 15b is received in the retainer 19 supported on the plunger seat disc 6 which is stacked on the spring housing block 17 and injector cup 18 with retainer 19 securing the received parts together in end-to-end fashion with the upper barrel part 5'. The reciprocating lower, metering and injection plunger 26 is received in a bore extending through lower barrel part 15b and a variable volume metering and injection chamber is formed between the bottom end of the metering and injection plunger 26 and the facing surface of the plunger seat disc 6. The flow of fuel through the orifices of nozzle 18a of injector cup 18 is controlled by the pressure responsive valve assembly 54 which includes valve pin 54b which is acted upon by valve spring 56 in a conventional manner.

At the end of the injection event, fuel remaining in the metering and injection chamber is returned to the engine drain path when it is pressurized to a level which opens drain valve V' by overcoming the force of a drain valve spring 5d that acts between a drain valve member formed by a valve spring keeper 68 and a shoulder 80 formed on an inside surface of the upper barrel part 5'. A plunger return spring s' acts between the lower metering and injection plunger 26 and the timing plunger 25' to return them to the position shown in FIG. 8 at the end of each injection cycle. For this purpose, the lower end of spring s' engages a spring keeper 62', that is supported on a shoulder of plunger 26, and the upper end of the spring s' engages a shoulder 25'd on the bottom end of timing plunger 25'. Thus, while spring s' still acts between the timing plunger 25' and the metering and injection plunger 26, in this embodiment, the lower spring keeper 62' for spring s' no longer serves as the valve member of the fuel drain valve, drain valve V' now being formed by a separate spring and lower spring keeper 60', 68. This change allows the pressure at which valve V' opens to be independently set, i.e., without consideration being given to force to be apply to the timing plunger 25 or the metering and injection plunger 26 as is the case when the return spring s for these plungers is also used for controlling opening of the drain valve V. Otherwise, metering and injection of fuel occurs as described above.

It should also be recognized that use of either of the drain passage valve arrangements in accordance with this invention, i.e., valves V or V', is not dependent upon whether or not a fuel supply path, including a double check valve plunger seat disc, as disclosed relative to the embodiment of FIGS. 3–7 is utilized. Likewise, this same concept will be applicable to closed nozzle fuel injectors of other constructions beyond those illustrated herein, and various other forms for such drain passage valves will become apparent to those skilled in the art based on the present disclosure. Accordingly, this invention should not be viewed as limited to the specific embodiments that are shown and described, and it is intended that this invention encompass the full scope of the appended claims.

INDUSTRIAL APPLICABILITY

The present invention will find applicability in a wide range of applications in fuel injection systems for internal combustion engines, particularly diesel engines. The invention will be especially useful where it is desired to have a fuel injection system that is able to achieve precise control over fuel metering to maximize fuel economy and minimize emissions in accordance with the requirements of a range of different engines and engine use conditions.

We claim:

1. In a fuel injector of the closed nozzle type having an injector body containing a central bore and injection orifices at a lower end of the injector body, a metering and injection plunger having a drain passage means formed therethrough for communicating with a low pressure area via a drain passage formed in the body of the fuel injector, said metering and injection plunger being mounted in said central bore in a manner defining a variable volume metering and injection chamber in a lower end of said central bore together with a flow distributing, plunger seat disc mounted between the lower end of said central bore and said injection orifices, said plunger seat disc containing an in-feed passage means for delivering fuel to said metering and injection chamber from an external source of pressurized fuel, and at least one injection passage through which fuel is supplied from said metering and injection chamber to said injection orifice; the improvement for preventing premature escape of fuel from said metering and injection chamber to said low pressure area via said drain passage comprising spring-loaded, pressure-responsive valve means disposed about said metering and injection plunger and acting on an outlet end of said drain passage.

2. A fuel injector according to claim 1, wherein said metering and injection plunger is part of a plunger assembly having an upper plunger and a timing plunger disposed between the upper plunger and said metering and injection plunger; wherein a return spring means for applying pressure on the timing plunger in a direction away from the metering and injection plunger is provided, an end of said spring means being retained by a spring keeper that is mounted about said metering and injection plunger; and wherein said spring keeper forms a pressure responsive valve means for blocking flow through the drain passage in the body of the fuel injector.

3. A fuel injector according to claim 2, wherein said drain passage means has an inlet located centrally in an end face of said metering and injection plunger; and wherein fuel distribution passage means is formed by a channel in an upper surface of the plunger seat disc, said channel running, from a point located radially outwardly of said metering and injection chamber, to at least the center of said plunger seat disc.

4. A fuel injector according to claim 3, wherein a pair of check valves are disposed in said fuel distribution passage means for preventing leakage of metered fuel from said injector.

5. A fuel injector according to claim 4, wherein said fuel distribution passage means comprises three fuel feed passages extending through said plunger seat disc radially outwardly of said metering and injection chamber, a circumferentially extending channel extending between a first and a second of said fuel feed passages at the upper surface of the plunger seat disc and a circumferentially extending channel extending between the second and a third of said fuel feed passages at an lower surface of the plunger seat disc; and wherein a said check valve is disposed in each of said first and third fuel feed passages.

6. A fuel injector according to claim 5, wherein said check valves are ball-type check valves, said first and third passages having upper ends that are enlarged for forming a seat for a ball member of the respective ball-type check valve.

7. A fuel injector according to claim 1, wherein the injector body comprises an upper injector barrel part, a lower injector barrel part, said flow plunger seat disc, a spring housing block, an injector cup having an injection nozzle with said injection orifices, and a retainer; wherein the retainer receives the injector cup, supported with its injection nozzle projecting from the bottom end thereof, the lower barrel part being received in the retainer supported on the plunger seat disc which is received in the retainer stacked on the spring housing block and injector cup; and wherein the retainer secures together the parts of the injector body that are received therein in end-to-end fashion with the upper barrel part.

8. A fuel injector according to claim 7, wherein a fuel distribution channel is formed in an upper surface of the plunger seat disc and is covered by said lower barrel part and a fuel distribution channel is formed in a lower surface of the plunger seat disc and is covered by the spring housing.

9. A fuel injector according to claim 1, wherein said metering and injection plunger is part of a plunger assembly having an upper plunger and a timing plunger disposed between the upper plunger and said metering and injection plunger; wherein a return spring means for applying pressure on the timing plunger in a direction away from the metering and injection plunger is provided, an end of said return spring means being retained by a return spring keeper that is mounted about said metering and injection plunger; and wherein a valve spring and valve spring keeper are provided, a lower end of said valve spring being retained by said valve spring keeper and an upper end thereof engaging a fixed surface of the injector body; and wherein said valve spring and valve spring keeper are disposed concentrically about said return spring means and return spring keeper and form said pressure-responsive valve means.

10. A fuel injector according to claim 9, wherein the injector body comprises an upper injector barrel part, a lower injector barrel part, said flow plunger seat disc, a spring housing block, an injector cup having an injection nozzle with said injection orifices, and a retainer; wherein the retainer receives the injector cup, supported with its injection nozzle projecting from the bottom end thereof, the lower barrel part being received in the retainer supported on the plunger seat disc which is received in the retainer stacked on the spring housing block and injector cup; and wherein the retainer secures together the parts of the injector body that are received therein in end-to-end fashion with the upper barrel part.

11. A fuel injector according to claim 10, wherein a fuel distribution channel is formed in an upper surface of the plunger seat disc and is covered by said lower barrel part and a fuel distribution channel is formed in a lower surface of the plunger seat disc and is covered by the spring housing.

12. A fuel injector according to claim 10, wherein said drain passage means has an inlet located centrally in an end face of said metering and injection plunges; and wherein fuel distribution passage means is formed by a channel in an upper surface the plunger seat disc, said channel running, from a point located radially outwardly of said metering and injection chamber, to at least the center of said plunger seat disc.

13. A fuel injector according to claim 12, wherein a pair of check valves are disposed in said fuel distribution passage means for preventing leakage of metered fuel from said injector.

14. A fuel injector according to claim 13, wherein said fuel distribution passage means comprises three fuel feed passages extending through said plunger seat disc radially outwardly of said metering and injection chamber, a circumferentially extending channel extending between a first and a second of said fuel feed passages at the upper surface of the plunger seat disc and a circumferentially extending channel extending between the second and a third of said fuel feed passages at an lower surface of the plunger seat disc; and wherein a said check valve is disposed in each of said first and third fuel feed passages.

15. A fuel injector according to claim 14, wherein said check valves are ball-type check valves, said first and third passages having upper ends that are enlarged for forming a seat for a ball member of the respective ball-type check valve.

16. In a fuel injector of the closed nozzle type having an injector body containing a central bore and injection orifices at a lower end of the injector body, a metering and injection plunger having a drain passage means formed therethrough for communicating with a low pressure area via a drain passage formed in the body of the fuel injector, said metering and injection plunger being mounted in said central bore in a manner defining a variable volume metering and injection chamber in a lower end of said central bore together with a flow distributing, plunger seat disc mounted between the lower end of said central bore and said injection orifices, the improvement for preventing premature escape of fuel from said metering and injection chamber to said low pressure area via said drain passage comprising spring-loaded, pressure-responsive valve means disposed about said metering and injection plunger and acting on an outlet end of said drain passage; wherein said pressure-responsive valve means comprises a valve spring and valve spring keeper; wherein said valve spring and valve spring keeper are disposed concentrically about said metering and injection plunger, a lower end of said valve spring being retained by said valve spring keeper and an upper end thereof engaging a fixed surface of the injector body; and wherein said valve spring keeper serves as a valve member for blocking and unblocking flow from said drain passage.

17. A fuel injector according to claim 16, wherein said metering and injection plunger is part of a plunger assembly having an upper plunger and a timing plunger disposed between the upper plunger and said metering and injection plunger

18. A fuel injector according to claim 17, wherein a return spring means for applying pressure on the timing plunger in a direction away from the metering and injection plunger is provided, an end of said return spring means being retained by a return spring keeper that is mounted about said metering and injection plunger.

19. A fuel injector according to claim 17, wherein the injector body comprises an upper injector barrel part, a lower injector barrel part, said flow plunger seat disc, a spring housing block, an injector cup having an injection nozzle with said injection orifices, and a retainer; wherein the retainer receives the injector cup, supported with its injection nozzle projecting from the bottom end thereof, the lower barrel part being received in the retainer supported on the plunger seat disc which is received in the retainer stacked on the spring housing block and injector cup; and wherein the retainer secures together the parts of the injector body that are received therein in end-to-end fashion with the upper barrel part.

20. A fuel injector according to claim 16, wherein the injector body comprises an upper injector barrel part, a lower injector barrel part, said flow plunger seat disc, a spring housing block, an injector cup having an injection nozzle with said injection orifices, and a retainer; wherein the retainer receives the injector cup, supported with its injection nozzle projecting from the bottom end thereof, the lower barrel part being received in the retainer supported on the plunger seat disc which is received in the retainer stacked on the spring housing block and injector cup; and wherein the retainer secures together the parts of the injector body that are received therein in end-to-end fashion with the upper barrel part.

* * * * *